United States Patent [19]

Commins et al.

[11] 4,417,431

[45] Nov. 29, 1983

[54] CLIP FOR RETAINING SHEET METAL ROOFING OR SIDING

[75] Inventors: Alfred D. Commins, Livermore; Frederick T. Kindelvich, Orinda, both of Calif.

[73] Assignee: Zip-Rib, Inc., Burlington, N.J.

[21] Appl. No.: 162,226

[22] Filed: Jun. 23, 1980

[51] Int. Cl.[3] ..... E04C 5/00

[52] U.S. Cl. ..... 52/715; 52/512; 52/520

[58] Field of Search ..... 52/546, 543, 544, 770, 52/773, 774, 509, 510, 512, 387, 564, 565, 715, 714, 520, 487, 346, 349, 355, 391; 248/316 D, 451; 211/42

[56] References Cited

U.S. PATENT DOCUMENTS

| | | | |
|---|---|---|---|
| 324,634 | 8/1885 | Anderson | 52/714 |
| 717,638 | 1/1903 | Taft | 52/714 |
| 863,919 | 8/1907 | Heinz | 52/714 |
| 933,925 | 9/1909 | Schirra | 52/714 |
| 1,816,226 | 7/1931 | Krabiel | 52/714 |
| 1,826,133 | 10/1931 | Hatch | 52/468 |
| 2,245,633 | 6/1941 | Wolfe | 52/468 |
| 2,251,840 | 8/1941 | Duffy | 52/391 |
| 2,328,977 | 9/1943 | Hasenburger | 52/520 |
| 2,379,269 | 6/1945 | Barrows | 52/512 |
| 2,394,443 | 2/1946 | Guignon | 52/471 |
| 2,831,222 | 4/1958 | Anderson . | |
| 3,312,028 | 4/1967 | Schroyer . | |
| 3,335,530 | 8/1967 | Hurd | 52/468 |
| 3,388,518 | 6/1968 | Scott . | |
| 3,469,866 | 9/1969 | Ashby | 52/509 |
| 3,555,758 | 1/1971 | Schroter . | |
| 3,609,933 | 10/1971 | Tahn | 52/464 |
| 3,708,943 | 1/1973 | Thomas . | |
| 3,982,373 | 9/1976 | Wilson . | |
| 4,044,517 | 8/1977 | Schroter . | |
| 4,107,887 | 8/1978 | Wendt | 52/512 |
| 4,194,336 | 3/1980 | Weinar | 52/509 |

FOREIGN PATENT DOCUMENTS

| | | | |
|---|---|---|---|
| 1079026 | 11/1954 | France | 52/543 |
| 1240911 | 8/1960 | France | 52/715 |
| 1210498 | 10/1970 | United Kingdom | 52/387 |

*Primary Examiner*—Price C. Faw, Jr.
*Assistant Examiner*—Henry E. Raduazo
*Attorney, Agent, or Firm*—Duffield & Lehrer

[57] ABSTRACT

A clip for retaining sheet metal roofing or siding panels on a structure, while providing for thermal expansion and contraction of the panels, is made from a single piece of sheet metal. The metal is cut and bent so as to form a base portion having panel supporting embossments, and an upright portion which has panel retaining bulbous projections adjacent the top edge. Preferably there is an even number of these bulbous projections and they alternate projecting to opposite sides of the upright portion. Most preferably, the clip is made of stainless steel when it is intended for use with aluminum panels. The clip is adapted to have its base portion affixed to a building structure and its upright portion enclosed within the seam joint between two adjacent metal roofing or siding sheets which are formed over the bulbous projections of the clip.

6 Claims, 4 Drawing Figures

CLIP FOR RETAINING SHEET METAL ROOFING OR SIDING

BACKGROUND OF THE INVENTION

This invention pertains to a clip adapted to retain sheet metal roofing or siding panels on a strucutre. At the same time, the clip permits thermal expansion and contraction of the panels.

Sheet metal roofing and siding have been used for many years and there are many means of fastening such sheets to a building structure. The following patents show various fastening methods: U.S. Pat. Nos. 2,831,222; 3,388,518; 3,708,943; and 3,982,373.

The clip of the present invention is particularly adapted for use in the roofing or siding system disclosed in U.S. Pat. No. 3,312,028 (see also U.S. Pat. No. 3,555,758). The invention of that patent pertains to a method of roll forming adjacent metal siding or roofing sheets to lock them together in a weather tight manner, at the same time structurally interlocking the sheets with a metal clip attached to the underlying building structure. The clip disclosed in U.S. Pat. No. 3,312,028 is a simplified, early version, whereas the clip of the present invention incorporates many advantages and improvements over the clips previously used. One such previously used clip is shown in FIG. 2 of the drawings (see also FIGS. 5, 6, and 7 of U.S. Pat. No. 4,044,517).

SUMMARY OF THE INVENTION

There is provided, according to this invention, a clip having a base portion and an upright portion formed substantially at right angles thereto, said upright portion having a lower edge attached to the base, two opposed side edges substantially perpendicular to the lower edge, and a top edge substantially parallel to the lower edge, characterized in that there are smooth bulbous projections adjacent to but spaced from the top edge of the upright portion whereby the top edge is substantially straight.

DETAILED DESCRIPTION

Figure 1:
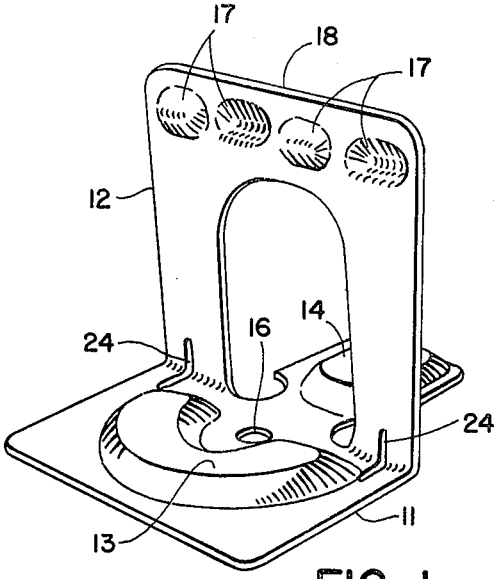
FIG. 1 is a perspective view of the clip according to this invention.

The clip of the present invention, which is preferably made of a single piece of metal, is characterized by a base portion 11 and an upright portion 12 substantially at right angles to each other. The base portion is divided into first and second section and contains an arcuate support embossment 13 on one side of upright 12 and a rectangular support embossment 14 on the other side in each of said first and second sections. These two supports provide wide, flat bearing areas to space the metal siding or roofing away from the structure to provide clearance for fasteners when the clip is in position in the finished structure. The hole 16 in base 11 is for fastening the metal clip to the building structure, for example by bolt, nail, screw, rivet, or the like.

The upright portion 12 has bulbous projections 17 along its upper edge 18. While any desired number of bulbous projections 17 can be used, in a preferred embodiment there is an even number of these and they are oriented so that alternate adjacent bulbous projections project to opposite sides of upright portion 12. The particular advantages of this structure will be discussed below.

Figure 3:
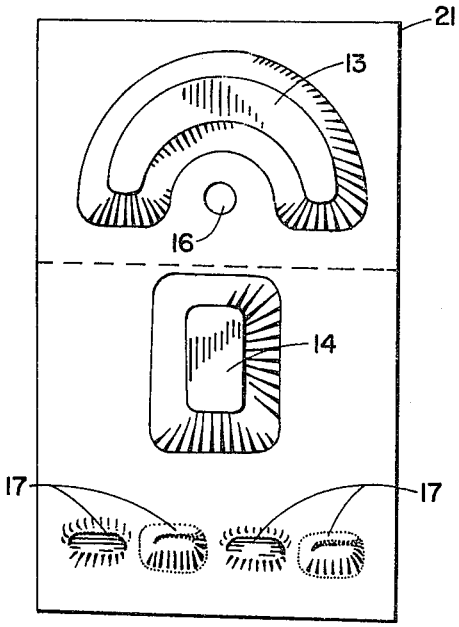
FIG. 3 is a plan view of the clip of this invention during an early stage in its manufacture.

The clip can be made in various ways. One commercially feasible method is to draw form a continuous metal strip in a progressive die for example one with six stages, although a larger or smaller number of stages or steps can be used. The metal is first stamped and punched so as to emboss in it arcuate support 13, rectangular support 14, and bulbous projections 17, as well as hole 16. This stage of the fabrication is illustrated in FIG. 3.

Figure 4:
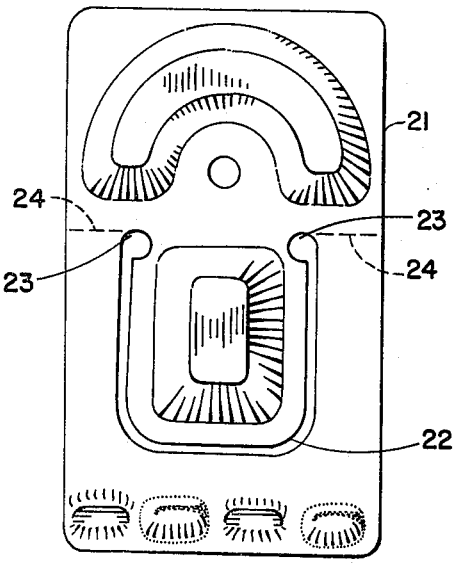
FIG. 4 is a plan view of the clip in a subsequent stage of its manufacture.

Next, the embossed blank 21 is cut to form U-shaped cut 22 and terminal holes 23, as illustrated in FIG. 4. This results in a pair of spaced apart legs and an upper section joining the tops of the legs together.

Finally, the blank 21 is bent along bend line 24 so that upright portion 12 is perpendicular to base portion 11. Crease-type reinforcements 24 stiffen the structure against lifting and other stresses which would tend to bend the clip.

Taking the second section of base 11 which contains rectangular support 14 from the center of upright portion 12 enables the clip to be made from a single piece of metal; it is also believed that the opening in the center of upright 12 which is of substantially the same shape but slightly larger than the second section of the base 11 gives flexibility to the clip, which leads to better alignment.

While the clip of the present invention may be made of any suitable material, it is preferably made of stainless steel when it is to be used with aluminum roofing or siding.

In use, clips according to the present invention are fastened to a building structure along a line which will underlie the joint between two roofing or siding sheets, typically at from 1.2 to 2 meter (3 to 6 foot) intervals. The roofing sheets, for example, will then be placed over the clips, each sheet having an open roll form at its edge, the edge of one sheet being placed over the clips first and the opposite edge of the other sheet laid over the edge of the first sheet. The interfitted edges of the two sheets are then interlocked, for example by roll-forming, to lock them securely together and around the bulbous projections of the clip, all as set forth in greater detail in U.S. Pat. No. 3,312,028.

Figure 2:
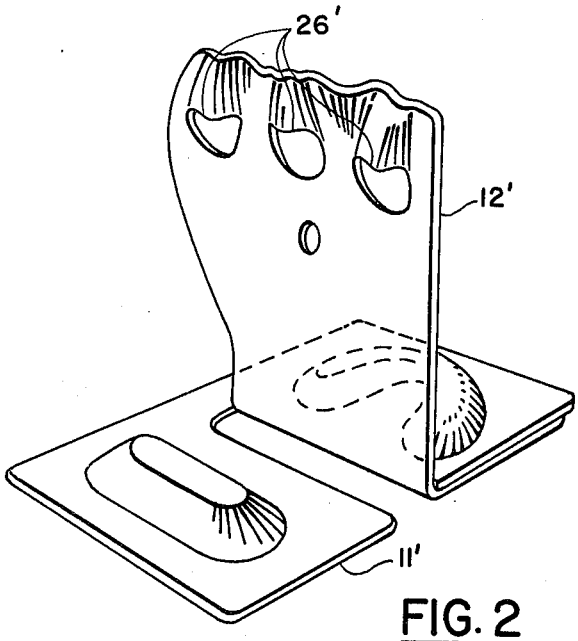
FIG. 2 PRIOR ART
FIG. 2 is a perspective view of a prior art clip.

The clip of the present invention has several advantages over prior art clips, particularly that shown in FIG. 2.

In the first place, the present clip is made of a single piece of metal, not two pieces of metal joined together as is the case with the clip of FIG. 2. Not only does this simplify manufacture of the clip, but it precludes the possibility that the two portions of the clip might separate.

One advantage of the one-piece structure is that a number of clips according to the present invention can be nested together for packing more efficiently, whereas the clip of FIG. 2 has no nesting capability.

Another advantage is related to the bulbous shape of the projections, as opposed to the "barbs" of the clip shown in FIG. 2, and flows from the fact that, due to thermal expansion and contraction, the metal roofing or siding moves longitudinally along the clip; in the case of the clip shown in FIG. 2, this can lead to "sawing" of the metal in the roofing, which might eventually lead to failure of the roof. The bulbous projections of the present clip, on the other hand, do not saw the sheet metal.

Still another advantage of the clip of this invention compared with the prior art clip is that, when subjected to strong upward forces, the three barbs in the upper edge of the prior art clip are subjected to 3-point loading, tending to bend the upper edge of the clip into a flatter configuration, more easily permitting the clip to escape from the joint between the roofing sheets. The preferred construction of the present clip, wherein there are an even number of bulbs extending alternately to opposite sides of the upright portion of the clip, greatly reduces the possibility of "pullout" of the clip.

The "wavy" top of the prior art clip has made it necessary to carefully guide the clip into place. The clip of the present invention, on the other hand, having a straight upper edge, is much more readily inserted.

On the other hand, even before the roof joint is "zipped" shut to lock the clip in place, the clip of the present invention "snaps" into place and is held much more firmly than the prior art clip.

We claim:

1. A nestable sheet metal clip for retaining sheet metal roofing or siding panels on a structure comprising:

a base portion, said base portion being comprised of first and second sections, said first section being substantially rectangularly shaped, said second section being smaller than said first section and lying in substantially the same plane therewith;

an upright portion substantially perpendicular with said base portion and being integral therewith, said upright portion including a pair of spaced apart legs, the bottom of each of said legs being integrally connected to the first section of said base portion at a point adjacent to the juncture between said first and second sections but lying laterally to either side of said second section, the top of said legs being connected together by an upper section having a top edge thereby leaving an opening defined by said legs and said top section, said opening being substantially of the same shape but slightly larger than the second section of said base portion;

a plurality of smooth bulbous projections adjacent to but spaced from said top edge of the upper section of said upright portion, whereby the top edge is substantially straight;

the entire clip being comprised of a single piece of sheet metal and having the same thickness throughout which thickness is equal to the thickness of said sheet metal from which the clip is comprised.

2. Clip according to claim 1 wherein there are an even number of bulbous projections, one-half projecting to one side of the upright portion and the other half projecting to the other side.

3. Clip according to claim 2 wherein the bulbous projections projecting to one side alternate with the bulbous projections projecting to the other side.

4. Clip according to claim 3 wherein there are four such bulbous projections.

5. Clip according to claim 1 wherein said base contains raised support portions.

6. Clip according to claim 1 made of stainless steel.

* * * * *